US009187999B2

(12) United States Patent
Galvan-Sanchez et al.

(10) Patent No.: US 9,187,999 B2
(45) Date of Patent: Nov. 17, 2015

(54) APPARATUS AND METHOD FOR OBTAINING FORMATION FLUID SAMPLES

(71) Applicants: Francisco Galvan-Sanchez, Houston, TX (US); Christopher J. Morgan, Spring, TX (US); Mario Hernandez, Spring, TX (US)

(72) Inventors: Francisco Galvan-Sanchez, Houston, TX (US); Christopher J. Morgan, Spring, TX (US); Mario Hernandez, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 236 days.

(21) Appl. No.: 13/691,108

(22) Filed: Nov. 30, 2012

(65) Prior Publication Data

US 2014/0151038 A1 Jun. 5, 2014

(51) Int. Cl.
*E21B 49/08* (2006.01)

(52) U.S. Cl.
CPC ..... *E21B 49/082* (2013.01); *E21B 49/08* (2013.01); *E21B 49/081* (2013.01)

(58) Field of Classification Search
CPC ..... E21B 49/081; E21B 49/082; E21B 49/08
USPC ..... 166/264, 107, 162, 166; 73/152.22, 73/152.24
See application file for complete search history.

(56) References Cited

U.S. PATENT DOCUMENTS 3,611,799 A * 10/1971 Davis ..... 73/152.24
8,020,437 B2 * 9/2011 Zhan et al. ..... 73/152.22
2004/0244971 A1 * 12/2004 Shammai et al. ..... 166/250.1

* cited by examiner

*Primary Examiner* — Yong-Suk (Philip) Ro
(74) *Attorney, Agent, or Firm* — Cantor Colburn LLP

(57) ABSTRACT

An apparatus for obtaining a fluid from a formation. The apparatus includes a fluid extraction device that extracts the fluid from the formation into a first fluid line, and a sample chamber that is coupled to the first fluid line via a second fluid line to receive the fluid from the first fluid line. The first fluid line and the second fluid line receive contaminated formation fluid when the fluid extraction device initially extracts the fluid from the formation. A fluid removal device associated with the second fluid line receives at least a portion of the contaminated formation fluid from the second fluid line.

21 Claims, 2 Drawing Sheets

APPARATUS AND METHOD FOR OBTAINING FORMATION FLUID SAMPLES

BACKGROUND OF THE DISCLOSURE

1. Field of the Disclosure

The present disclosure relates generally to formation fluid collection and testing.

2. Description of the Related Art

During drilling of a wellbore and after the drilling process, clean fluid from the formation is often extracted to determine the nature of the hydrocarbons in hydrocarbon-bearing formations. Fluid samples are often collected in multiple chambers and the collected samples are tested to determine various properties of the extracted formation fluid. To drill a well, drilling fluid is circulated under pressure greater than the pressure of the formation in which the well is drilled. The drilling fluid invades into the formation to varying depths, thus contaminating the fluid in the invaded section or zone. To collect clean formation fluid samples, a formation testing tool is conveyed into the wellbore. A pump typically extracts the formation fluid via a sealed probe placed against the inside wall of the wellbore. An initial portion or amount of the extracted fluid is the contaminated fluid, which typically flows through a tortuous flow line to which sample chambers are connected via secondary flow lines. These secondary flow lines may retain a certain volume of the contaminated fluid. When the clean formation fluid is supplied to a sample chamber, the contaminated fluid in its associated secondary line enters the sample chamber. It is desirable to remove the contamination from the secondary lines before collecting the formation fluid in the sample chambers.

The disclosure herein provides apparatus and method for collecting and testing formation fluids that remove at least some of the contamination in the fluid lines before collecting formation fluid samples in sample chambers.

SUMMARY

In one aspect, an apparatus for obtaining a fluid from a formation is disclosed that in embodiment may include a fluid extraction device that extracts the fluid from the formation into a first fluid line, a sample chamber coupled to the first fluid line via a second fluid line that receives the fluid from the first fluid line, wherein the first fluid line and the second fluid line receive contaminated formation fluid when the fluid extraction device initially extracts the fluid from the formation, and a fluid removal device associated with the second fluid line for receiving at least a portion of the contaminated formation fluid from the second fluid line.

In another aspect, a method of obtaining a sample from a formation is disclosed that in one embodiment may include: conveying a tool into a wellbore that includes a first fluid line for receiving fluid extracted from a formation, a sample chamber coupled to the first fluid line via a second fluid line that receives the fluid from the first fluid line when the fluid from the formation is extracted into the first fluid line; extracting the fluid from the formation into the first fluid line and the second fluid line; supplying the fluid from the second fluid line into a fluid removal device; and supplying the fluid from the second fluid line into the sample chamber after supplying the at least a portion of the fluid from the second fluid line into the fluid removal device.

Examples of certain features of the apparatus and method disclosed herein are summarized rather broadly in order that the detailed description thereof that follows may be better understood. There are, of course, additional features of the apparatus and method disclosed hereinafter that will form the subject of the claims.

BRIEF DESCRIPTION OF THE DRAWINGS

For detailed understanding of the present disclosure, references should be made to the following detailed description, taken in conjunction with the accompanying drawings, in which like elements have been given like numerals and wherein.

DESCRIPTION OF THE DISCLOSURE

Figure 1:
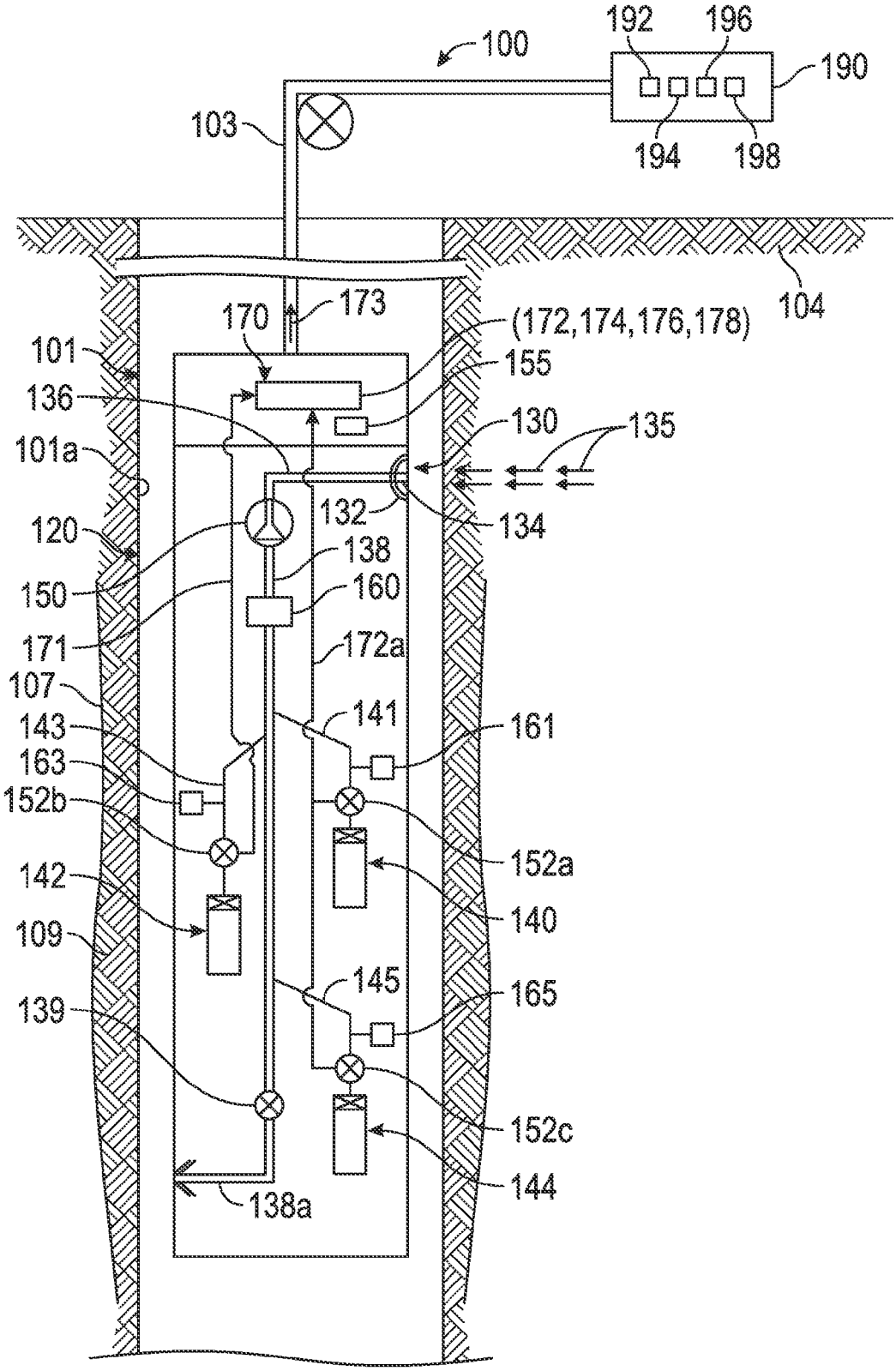
FIG. 1 is a schematic diagram of an exemplary wireline system for obtaining formation fluid into a sample, according to one embodiment of the disclosure.

FIG. 1 is a schematic diagram of an exemplary formation testing system 100 for obtaining formation fluid samples and retrieving such samples for testing to determine properties of such fluid. The system 100 is shown to include a downhole tool 120, generally referred to as the formation evaluation tool, deployed in a wellbore 101 formed in formation 102. The tool 120 is shown conveyed by a conveying member 103, such as a wireline or coiled tubing, from a surface location 104. In one embodiment, the tool 120 includes a fluid withdrawal device 130 that includes a sealing device 132 and a probe 134 having a fluid flow path 136. In one embodiment, the probe 134 may be centered in the pad 132, wherein when the pad 132 is pressed against an inside wall 101*a* of the wellbore 101, where the probe 134 penetrates in the formation 102. Formation fluid 135 withdrawn from the formation 102 enters the probe 134 and into a main fluid line 138 in the tool 120.

In one embodiment, one or more chambers (also referred to herein as sample chambers) are connected to the main fluid line 138 for collecting and storing the formation fluid withdrawn into the probe 134. In the particular embodiment of FIG. 1, three exemplary sample chambers 140, 142 and 144 are shown connected to the main fluid line 138 respectively via separate secondary fluid lines 141, 143 and 145. A pump 150 associated with or connected to the main fluid line 138 may be utilized to withdraw the formation fluid 135 into the probe 134 and thus into the main fluid line 138. The withdrawn fluid 135 may be selectively pumped into the sample chambers via their respective secondary fluid lines. A flow control valve in each of the secondary fluid flow line controls the flow of the formation fluid into the sample chambers. FIG. 1 shows a flow control device 152*a* a controlling the flow of the fluid from its secondary fluid line 141 into the sample chamber 140, flow control device 152*b* into sample chamber 142 and flow control device 152*c* into sample chamber 144. Any suitable flow control device(s) may be utilized for controlling the flow of the fluid into the sample chambers, including, but not limited to, a solenoid and a hydraulically-operated valve.

Wellbores, such as wellbore 101, are drilled using a circulating fluid, commonly known as "mud". The pressure of the mud at any depth is greater than the formation pressure at that depth. The mud, therefore, penetrates into the porous rock of the formation 102 to varying extent, such as shown by irregular line 107. The zone between the wall 101*a* of the wellbore 101 and the line 107 is referred to as the invaded zone 109.

Thus, the invaded zone 109 contains a mixture of the mud and the pure formation fluid (also referred to as the "connate fluid"). Thus, the fluid in the invaded zone 109 is a contaminated connate fluid. To obtain samples of the connate or mostly connate fluid, the pad 132 and the probe 134 are pressed against the wellbore wall at a selected depth. The pad 132 provides a seal around the probe 134. The pump 150 is then operated to withdraw fluid 135 from the formation 102 into the main fluid line 138. A fluid analyzer 160 in the main fluid line determines the level of contamination passing through the main line 138. Any suitable fluid analyzer, including, but not limited to, optical devices known in the art may be utilized for the purpose of this disclosure. The contamination level typically decreases over time as the fluid is withdrawn. As long as the contamination level remains above a selected threshold level, the withdrawn fluid may be discharged into the wellbore 101 via a flow control device 139 and an outlet 138*a* in fluid line 138. Once the contamination level reaches a desired level (i.e. the fluid being withdrawn is clean), the fluid from the formation is selectively directed to the sample chambers 140, 142 and 144 by opening the respective valves 152*a*, 152*b* and 152*c* in a desired sequence.

When the contaminated formation fluid passes through the main fluid line 138 and into the wellbore 101, it also fills the secondary fluid lines between the main fluid line 138 and the sample chambers 140, 142 and 144 (where the filled portion of the secondary fluid lines is also referred to herein as the "dead volume"). When the clean fluid is discharged from the main fluid line 138 into a sample chamber, the contaminated fluid in its secondary fluid line first enters into the sample chamber. It is, therefore, desirable to remove the contaminated fluid from the secondary fluid lines before directing the clean fluid into the sample chambers. In one aspect, a contaminated fluid removal device may be provided in or associated with a secondary fluid line to receive or collect the contaminated fluid from the dead volume before the clean fluid enters its associated sample chamber. In the formation evaluation tool of FIG. 1, a contamination removal device 161 is shown associated with fluid line 141, device 163 associated with fluid line 143 and device 165 associated with fluid line 145. As noted above, to obtain formation fluid samples, the pump 150 is activated and the formation fluid is discharged into the wellbore. When it is determined that the contamination level in the withdrawn fluid 135 is at an acceptable level, the flow control devices 152*a*, 152*b* and 152*c* may be opened to direct the fluid from the main fluid line 138 respectively into the secondary fluid lines 141, 143 and 145. For example, with respect to sample chamber 140, the fluid in line 141 will first pass to the device 161 before the fluid will enter the sample chamber 140, thereby removing at least a portion of the contaminated fluid in line 141. Similarly, fluid from fluid line 143 will first pass to the device 163 and fluid from fluid line 145 will first pass to the device 165. The operation of devices 161, 163 and 165 is described in more detail in reference to FIG. 2.

Still referring to FIG. 1, the tool 120 may include a controller 170 that is operatively coupled to the flow control devices 152*a*, 152*b* and 152*c* via a common bus 171. The controller 170 may bi-directionally communicate with a surface controller 190, via one or more communication and power lines 173 in the conveying member 103. In one aspect, the controller 170 may include electrical circuits 172*a* for operating the flow control devices and the pump 150, a processor 174, such as a microprocessor, for controlling the circuit 172*a* and thus the flow control devices 152*a*, 152*b* and 152*c*, one or more storage devices 176, such as solid state memories, and one or more programs 178 accessible to the processor 172 for executing instruction therein. Similarly, the surface controller 190 may include electrical circuits 192, processor 194, storage devices 196 and programs 198. In aspects, the surface controller 190 may send instructions to the downhole controller 170 regarding the operation of the flow control devices 152*a*, 152*b*, 152*c* and the pump 150, including the sequence of operation of such devices. The downhole controller 170 may send information from the fluid analyzer 160 to the surface controller 190. In an embodiment when the flow control devices 152, 152*b* and 152*c* include a solenoid and a hydraulically-operated valve, the controller(s) 170 and/or 190 activates a selected solenoid that opens or closes a corresponding hydraulically-operated valve and allows the fluid from the main line 138 to enter the selected sample chamber. In an aspect, the hydraulic fluid to the valve may be supplied by a hydraulic unit 155 in the tool 120.

Figure 2:
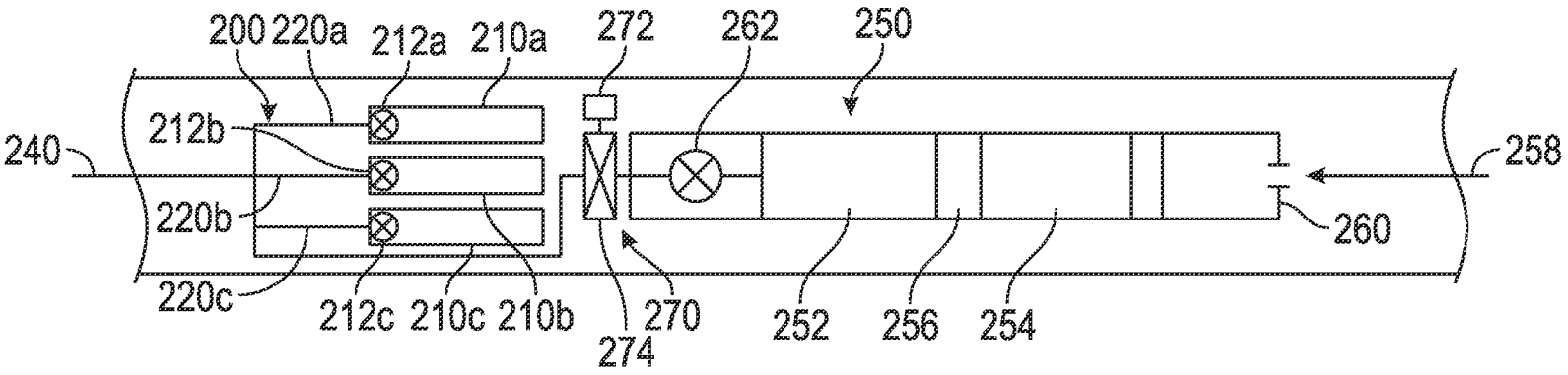
FIG. 2 shows a schematic diagram of a device for collecting fluid from a dead volume space associated with the sample chamber, according to one embodiment of the disclosure.

FIG. 2 shows an exemplary fluid removal device 200 associated with a sample chamber 250. Both the sample chamber 250 and the fluid removal device 200 are shown connected to a secondary fluid line 240 that is further connected to the main fluid line 138 (FIG. 1). The sample chamber 250 is shown to include a sample storage area (sample carrier) 252 and a back pressure device 254. In one embodiment, the back pressure device 254 may be a high pressure carrier, such as compressed nitrogen, that applies pressure on the sample carrier 252 via a piston 256. In another embodiment, the back pressure may be the hydrostatic pressure 258 applied on the sample carrier via an opening 260. A manual valve 262 may be provided in the sample chamber 250 for removal of the sample from the sample chamber 250 at the surface. The manual valve is typically set at the surface. A flow control device 270 allows the fluid from the fluid line 240 to enter the sample chamber. As noted above, the flow control device 270, in one embodiment, may include a hydraulically-operated valve 272 and a solenoid 274, which when activated allows the valve to open. In aspects, the sample removal device 200 may include one or more small chambers. For convenience and for distinguishing such small chambers from the sample chamber 250, such small chambers are referred to herein as carriers or micro-carriers. In the particular example of FIG. 2, three micro-carriers 210*a*, 210*b* and 210*c* are shown associated with the sample chamber 250. Each of the micro-carriers includes a fluid control device, such as a check valve. In FIG. 2, the micro-carrier 210*a* receives fluid from check valve 212*a* via connection line 220*a*, micro-carrier 210*b* receives fluid from check valve 212*b* via connection line 220*b* and micro-chamber 210*c* receives fluid from check valve 212*c* via connection line 220*c*. In aspects, the check valves 212*a*, 212*b* and 212*c* may be preset so as they will open at different pressures. Such an arrangement enables the fluid to enter into the micro-carriers in a desired sequence. For example, valve 212*a* may be set to open at pressure 212*x*, valve 212*b* at pressure 212*y* and valve 212*c* at pressure 212*z*. In one configuration, all micro-carriers may be set to receive the formation fluid from line 240 before the valve 270 is opened for the sample chamber 250 to receive the formation fluid. In another configuration at least one micro-carrier may be set to receive the formation fluid from fluid line 240 before the sample chamber 250, while the remaining micro-carriers receive the fluid from line 240 after the sample chamber 250. In yet another configuration, only one micro-carrier may be used.

Referring to FIGS. 1 and 2, to collect formation fluid in a particular sample chamber, such as sample chamber 250, the pump 150 is activated to supply the formation fluid 135 under pressure into the main flow line 138. The contaminated fluid is discharged into the wellbore 101. Once the fluid is clean, the pressure in the pump may be increased to a level that will cause one of the micro-carriers to receive fluid from fluid line 240. The pressure may be adjusted to cause the remaining micro-carriers to receive the fluid from fluid line 240 in a desired sequence. Alternatively, one or more micro-chambers may receive the fluid first followed by the sample chamber and then followed the remaining micro-carriers, as discussed above. The sequence in which the micro-carriers and the sample chambers are filled may be controlled by the downhole controller 170 and/or surface controller 190. In an aspect, the sequence in which the micro-carriers 212*a*, 212*b*, 212*c* will receive the formation fluid is from the least pressure setting to the highest pressure setting of the check valves 212*a*, 212*b* and 212*c*. As noted above, in some situations, it may be desirable to fill one or more micro-carriers after their associated sample chamber has been filled. Once the tool has been retrieved to the surface, the device 200 may be removed or detached from the sample chamber 250. The one or more micro-carriers may then be removed from the device 200 and the fluid contained therein may be analyzed without altering the fluid in the sample chamber 250. Such a procedure provides a noninvasive sample validation of the fluid in the sample chamber 250.

Although the tool 120 is shown as a wireline tool, all substantive aspects of the apparatus and methods described herein for obtaining fluid samples are equally applicable to while-drilling tools. In drilling operations, a bottomhole assembly that includes a drill bit is used to drill the wellbore. For drilling operations, the formation evaluation tool 120 may be integrated into the bottomhole assembly at any suitable location above the drill bit. To obtain a formation fluid sample, the drilling is stopped, the device 130 (FIG. 1) is set against the wellbore wall and the formation fluid samples may then be obtained in the manner described herein.

While the foregoing disclosure is directed to the preferred embodiments of the disclosure, various modifications will be apparent to those skilled in the art. It is intended that all variations within the scope and spirit of the appended claims be embraced by the foregoing disclosure.

The invention claimed is:

1. An apparatus for obtaining a fluid from a formation, comprising:

a fluid extraction device for extracting the fluid from the formation into a first fluid line;

a sample chamber coupled to the first fluid line via a second fluid line that receives the fluid from the first fluid line, wherein the first fluid line and the second fluid line receive formation fluid that includes contaminated formation fluid; and a fluid removal device associated with the second fluid line, the fluid removal device receiving at least a portion of the contaminated formation fluid from the second fluid line before the sample chamber receives the formation fluid.

2. The apparatus of claim 1, wherein the fluid removal device includes at least one carrier for collecting the contaminated formation fluid from the second fluid line.

3. The apparatus of claim 2, wherein the fluid removal device includes a plurality of carriers that receive fluid from the second fluid line in a selected sequence.

4. The apparatus of claim 3, wherein the selected sequence includes at least one carrier receiving the contaminated formation fluid from the second fluid line before the sample chamber receives the fluid from the second fluid line.

5. The apparatus of claim 3, wherein at least one carrier receives the fluid from the second fluid line after the sample chamber receives the fluid from the second fluid line.

6. The apparatus of claim 1, further comprising a flow control device associated with the sample chamber for supplying the fluid from the second fluid line into the sample chamber.

7. The apparatus of claim 1, wherein the fluid extraction device includes a pump that supplies the fluid from the formation under pressure into the first fluid line.

8. The apparatus of claim 1, wherein the sample chamber includes a back pressure device that causes the sample chamber to receive the fluid from the second fluid line against a selected pressure.

9. The apparatus of claim 8, wherein the selected pressure is one of: pressure generated by a compressed gas; and hydrostatic pressure.

10. The apparatus of claim 8, further comprising a controller that controls a supply of the fluid from the second fluid line into the sample chamber.

11. The apparatus of claim 1, further comprising a sensor associated with the fluid extracted from the formation that determines a contamination level in the fluid extracted from the formation.

12. The apparatus of claim 11, wherein the sensor includes an optical device.

13. The apparatus of claim 1, wherein the fluid removal device further includes a check valve that opens to enable the fluid removal device to receive the contaminated formation fluid from the second fluid line at a pressure in the second fluid line that is at or above a selected pressure.

14. A method of obtaining a sample from a formation, comprising:

conveying a tool into a wellbore that includes a first fluid line for receiving fluid extracted from a formation and a sample chamber coupled to the first fluid line via a second fluid line that receives the fluid from the first fluid line;

extracting the fluid from the formation into the first fluid line and the second fluid line;

supplying at least a portion of the fluid from the second fluid line into a fluid removal device; and supplying the fluid from the second fluid line into the sample chamber after supplying the at least a portion of the fluid from the second fluid line into the fluid removal device.

15. The apparatus of claim 14, wherein supplying the fluid into the fluid removal device includes supplying the fluid to a plurality of carriers in a selected sequence.

16. The method of claim 15, wherein the selected sequence includes at least one carrier receiving the fluid from the second fluid line after the sample chamber receives the fluid from the second fluid line.

17. The method of claim 14, further comprising determining a contamination level in the fluid extracted from the formation and supplying the fluid from the second fluid line to the fluid removal device and the sample chamber for fluid in which the contamination level is below a selected level.

18. The method of claim 14, further comprising controlling the supplying of the fluid into the sample chamber by a controller located at one of: in the tool; at a surface location; and a combination of controllers located in the tool and a surface location.

19. The method of claim 14, further comprising supplying the fluid from the second fluid line into the sample chamber against a pressure that is generated by one of: a pressurized gas; and hydrostatic pressure.

20. The method of claim 14, wherein the fluid supplied from the second fluid line into the fluid removal device is supplied via a check valve.

21. The method of claim 14, wherein extracting the fluid from the formation includes:

sealing a probe against the formation;

extracting the fluid from the formation by a pump into the first fluid line; and discarding the fluid extracted from the formation until a contamination in the fluid extracted from the formation is above a selected level.

* * * * *